US008542156B2

(12) United States Patent
Patel

(10) Patent No.: US 8,542,156 B2
(45) Date of Patent: Sep. 24, 2013

(54) PEDESTAL FOR TRACKING ANTENNA

(75) Inventor: Trushar D. Patel, Hercules, CA (US)

(73) Assignee: Sea Tel, Inc., Concord, CA (US)

( * ) Notice: Subject to any disclaimer, the term of this patent is extended or adjusted under 35 U.S.C. 154(b) by 952 days.

(21) Appl. No.: 12/638,872

(22) Filed: Dec. 15, 2009

(65) Prior Publication Data

US 2010/0149059 A1 Jun. 17, 2010

Related U.S. Application Data

(60) Provisional application No. 61/122,698, filed on Dec. 15, 2008.

(51) Int. Cl.
*H01Q 3/00* (2006.01)

(52) U.S. Cl.
USPC ..... 343/765; 343/766; 343/882

(58) Field of Classification Search
USPC ..... 343/765, 766, 882
See application file for complete search history.

(56) References Cited

U.S. PATENT DOCUMENTS 4,295,621 A * 10/1981 Siryj ..... 248/183.2
4,596,989 A 6/1986 Smith et al.
4,685,649 A 8/1987 McKay
5,517,204 A * 5/1996 Murakoshi et al. ..... 343/765
5,751,254 A 5/1998 Bird et al.
6,530,563 B1 3/2003 Miller et al.
7,298,342 B2 * 11/2007 Young et al. ..... 343/765
7,374,137 B2 * 5/2008 Staney ..... 248/122.1
7,446,723 B2 * 11/2008 Osaka et al. ..... 343/766
7,463,206 B1 * 12/2008 Kyhle ..... 343/766
2006/0086207 A1 4/2006 Swenson
2008/0258988 A1 10/2008 Son et al.

* cited by examiner

*Primary Examiner* — Dieu H Duong
(74) *Attorney, Agent, or Firm* — Morgan, Lewis & Bockius LLP; Victor E. Johnson

(57) ABSTRACT

A pedestal for tracking antenna includes a horizontal isolation assembly dimensioned and configured to isolate the support plate from horizontal vibration and shock of the base ring, a hub assembly including a support mounted on the horizontal isolation assembly rotatably supporting a rotating frame about a first azimuth axis, a vertical isolation assembly including an upright frame and a cross-level axis support slidably interconnected with a linear bearing assembly, the linear bearing assembly having a profiled rail slidably received within a complementary shaped bearing block, wherein the profiled rail can not twist axially relative to the bearing block, a cross-level frame pivotally mounted on the cross-level axis support about a second cross-level axis, and/or an elevation frame assembly supporting the tracking antenna and pivotally mounted on the cross-level frame about a third elevation axis.

23 Claims, 14 Drawing Sheets

PEDESTAL FOR TRACKING ANTENNA

CROSS-REFERENCES TO RELATED APPLICATIONS

This application claims priority to U.S. Provisional Patent Application No. 61/122,698 filed Dec. 15, 2008, entitled PEDESTAL FOR TRACKING ANTENNA, the entire contents of which is incorporated herein for all purposes by this reference

BACKGROUND OF THE INVENTION

1. Field of the Invention

This invention relates, in general, to pedestals for tracking antenna and more particularly to satellite tracking antenna pedestals used on ships and other mobile applications and methods for their use.

2. Description of Related Art

The invention is especially suitable for use aboard ship wherein an antenna is operated to track a transmitting station, such as a communications satellite, notwithstanding roll, pitch, yaw, and turn motions of a ship at sea.

Antennas used in shipboard satellite communication terminals typically are highly directive. For such antennas to operate effectively they must be pointed continuously and accurately in the direction toward the satellite.

When a ship changes its geographical position, or when the satellite changes its position in orbit, and when the ship rolls, pitches, yaws and turns, an antenna mounted on the ship will tend to become misdirected. In addition to these disturbances the antenna will be subjected to other environmental stresses such as vibrations caused by shipboard machinery and shocks caused by wave pounding. All of these effects must be compensated for so that the antenna pointing can be accurately directed and maintained in such direction.

Compactness in size and lightness in weight are of paramount importance for antenna pedestals used on ships. Small ships and boats which operate in rough seas routinely experience roll amplitudes of +/−35 degrees or more, pitch amplitudes of +/−15 degrees, and repetitive wave pounding shocks of 2 g's. Antenna pedestals which are compact and light yet rugged are highly desired.

An exemplar of the prior art is U.S. Pat. No. 5,419,521 to Matthews which shows a three-axis pedestal. While the disclosed pedestal is quite effective, additional stabilization may be necessary, for example, during extremely rough seas and gale force winds, and additional serviceability would be advantageous.

In particular, modern edge mast-mounted satellite antennas demand isolation from vibration and shock generated by ship for better pointing accuracy and long structural life. Moreover, given the demanding environments of operation, modern edge mast-mounted satellite antennas would benefit from improved designs which facilitate at-site maintenance and repair.

It would therefore be useful to provide an improved pedestal for a tracking antenna having vertical and horizontal vibration isolation and readily accessible components to overcome the above and other disadvantages of known pedestals.

BRIEF SUMMARY OF THE INVENTION

Briefly described, the stabilized antenna pedestal embodying the invention is mounted on and extends upwardly from a mounting surface such as on a platform attached to a ship's mast or above a pilothouse or bridge. The pedestal generally includes a plurality of axes and structural members which support an antenna and which, through drive means responsive to control signals, stabilizes the antenna for pitch, roll, and yaw motions of a ship, and which continuously points the antenna in any desired direction.

An aspect of the present invention may be directed to a pedestal for a tracking antenna for obtaining rotational stabilization of the antenna about three mutually intersecting axes, said pedestal including a horizontal isolation assembly dimensioned and configured to isolate the support plate from horizontal vibration and shock of the base ring, a hub assembly including a support mounted on the horizontal isolation assembly rotatably supporting a rotating frame about a first azimuth axis, a vertical isolation assembly including an upright frame and a cross-level axis support slidably interconnected with a linear bearing assembly, the linear bearing assembly having a profiled rail slidably received within a complementary shaped bearing block, wherein the profiled rail can not twist axially relative to the bearing block, a cross-level frame pivotally mounted on the cross-level axis support about a second cross-level axis, and/or an elevation frame assembly supporting the tracking antenna and pivotally mounted on the cross-level frame about a third elevation axis.

The horizontal isolation assembly may include a base and a support plate interconnected by a wire rope assembly dimensioned and configured to isolate the support plate from horizontal vibration and shock of the base, wherein the wire rope assembly may include upper and lower elongated members respectively mounted on the base and support plate, and a wire rope interconnecting the upper and lower elongated members, and/or wherein one of the upper and lower elongated members may be longer than the other of the upper and lower elongated members whereby a fastening aperture of said one elongated member may be spaced from and does not face said other elongated member. The upper and lower elongated members may each include a plurality of transverse through-bores, and wherein the wire rope may be threaded through all but a central one of the through-bores.

The support of the hub assembly may include a collar fixedly mounted on the support plate of the horizontal isolation assembly.

The linear bearing assembly may be offset from and substantially parallel to the first axis, and the second and third axis intersect one another substantially along the first axis.

The base of the vertical isolation assembly may include a counterweight diametrically opposed from the linear bearing assembly with respect to the first azimuth axis. The counterweight may include material that has been removed from a support plate of the horizontal isolation assembly.

The vertical isolation assembly further may include a support spring and a dampener interconnecting the upright frame and cross-level axis support. The support spring and dampener may be arranged in parallel with one another. The dampener may be a pneumatic cylinder open to atmosphere.

The horizontal isolation assembly further may include a driven gear affixed to the support plate, and/or the vertical isolation assembly further may include an azimuth-axis drive motor operably connected to the driven gear. The driven gear may be a sprocket, and wherein a drive chain located between the vertical isolation assembly and the horizontal isolation assembly operably connects the azimuth-axis drive motor to the sprocket.

Another aspect of the present invention is directed to a pedestal for a tracking antenna for obtaining rotational stabilization of the antenna about three mutually intersecting axes, said pedestal including a horizontal isolation assembly dimensioned and configured to isolate the support plate from horizontal vibration and shock of the base, a hub assembly including a support mounted on the horizontal isolation assembly rotatably supporting a rotating frame about a first azimuth axis, a vertical isolation assembly including an upright frame and a cross-level axis support slidably interconnected with a linear bearing assembly, the vertical isolation assembly may include a support spring and a dampener interconnecting the upright frame and cross-level axis support to dampen relative movement between the cross-level axis support and the upright frame, a cross-level frame pivotally mounted on the cross-level axis support about a second cross-level axis, and/or an elevation frame assembly supporting the tracking antenna and pivotally mounted on the cross-level frame about a third elevation axis.

The horizontal isolation assembly may include a base and a support plate interconnected by a wire rope assembly dimensioned and configured to isolate the support plate from horizontal vibration and shock of the base, wherein the wire rope assembly may include upper and lower elongated members respectively mounted on the base and support plate, and a wire rope interconnecting the upper and lower elongated members, and/or wherein one of the upper and lower elongated members may be longer than the other of the upper and lower elongated members whereby a fastening aperture of said one elongated member may be spaced from and does not face said other elongated member. The upper and lower elongated members each include a plurality of transverse through-bores, and wherein the wire rope may be threaded through all but a central one of the through-bores.

The support of the hub assembly may include a collar fixedly mounted on the support plate of the horizontal isolation assembly.

The linear bearing assembly may be offset from and substantially parallel to the first axis, and the second and third axis intersect one another substantially along the first axis. The base of the vertical isolation assembly may include a counterweight diametrically opposed from the linear bearing assembly with respect to the first azimuth axis. The counterweight may include material that has been removed from a support plate of the horizontal isolation assembly. The dampener may be a pneumatic cylinder open to atmosphere. The linear bearing assembly may have a profiled rail supporting the cross-level axis support and being slidably received within a complementary shaped bearing block affixed to the upright frame, wherein the profiled rail can not twist axially relative to the bearing block.

A further aspect of the present invention is directed to a pedestal for a tracking antenna for obtaining rotational stabilization of the antenna about three mutually intersecting axes, said pedestal including a horizontal isolation assembly dimensioned and configured to isolate the support plate from horizontal vibration and shock of the base, the horizontal isolation assembly including a driven gear affixed to the support plate, a hub assembly including a support mounted on the horizontal isolation assembly rotatably supporting a rotating frame about a first azimuth axis, a vertical isolation assembly including an upright frame and a cross-level axis support slidably interconnected with a linear bearing assembly, the vertical isolation assembly may include an azimuth-axis drive motor operably connected to the driven gear, a cross-level frame pivotally mounted on the cross-level axis support about a second cross-level axis, and/or an elevation frame assembly supporting the tracking antenna and pivotally mounted on the cross-level frame about a third elevation axis.

The driven gear may be a sprocket located between the vertical isolation assembly and the horizontal isolation assembly, and wherein and a drive chain operably connects the azimuth-axis drive motor to the sprocket.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In its simplest form the present invention includes supporting structural members, bearings, and drive means for positioning various rotating and pivoting structural members which are configured to align a tracking antenna about three axis, an azimuth axis, a cross-level axis, and an elevation axis.

Antenna stabilization is achieved by activating drive means for each respective axis responsive to external stabilizing control signals. In some aspects, the pedestal of the present invention is similar to that disclosed by U.S. Pat. No. 5,419,521 to Matthews, the entire content of which is incorporated herein for all purposes by this reference, as well as those used in the Sea Tel® 4006 and Sea Tel® 6006 and other satellite communications antennas sold by Sea Tel, Inc. of Concord, Calif.

Generally, when a ship is not in motion, for example, when it is in port, antenna pointing in train and elevation coordinates is relatively simple. But when underway, the ship rolls and/or pitches thus causing the antenna to point in an undesired direction. As such, corrections of the train and elevation pointing angles of the antenna are required. Each of the new pointing commands requires solution of a three-dimensional vector problem involving angles of ship's heading, roll, pitch, train, and elevation. When considering three-axis pedestals, when a ship is motionless antenna pointing in elevation and train coordinates is relatively simple, however, components of roll, pitch and yaw angles all affect antenna pointing direction.

A pedestal in accordance with the present invention includes provides support means for tilt sensors, accelerometers, angular rate sensors, Earth's magnetic field sensor, and other instruments useful for generating pedestal stabilizing control signals. Sensors and instruments may be used to obtain pedestal stabilization and antenna position control in otherwise conventional manners, such as those described by the above-mentioned '521 patent, as well as those used in the above-mentioned Sea Tel® 4006, Sea Tel® 6006, and other Sea Tel® satellite communications antennas.

Figure 1:
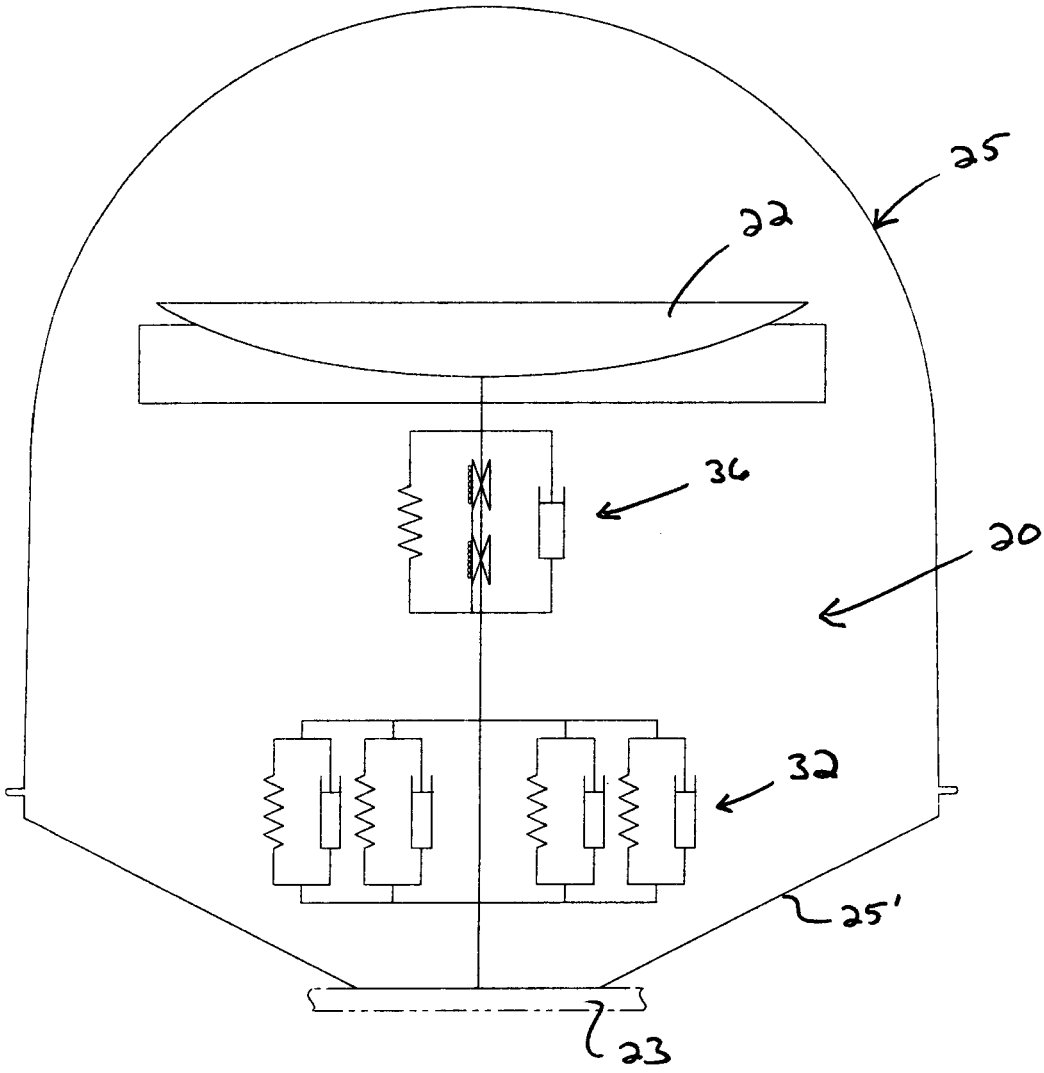
FIG. 1 is a schematic view of an exemplary pedestal for tracking antenna in accordance with various aspects of the present invention.

Turning now to the drawings, wherein like components are designated by like reference numerals throughout the various figures, attention is directed to FIG. 1 which schematically shows a three-axis pedestal 20 of the present invention generally supporting a satellite communications antenna 22 on a mount 23 within a protective radome 25. The mount is adapted to be mounted on a mast or other suitable portion of a vessel having a satellite communication terminal. The terminal contains communications equipment and otherwise conventional equipment for commanding the antenna to point toward the satellite in elevation and azimuth coordinates. Operating on the pedestal in addition to those antenna pointing commands is a servo-type stabilization control system which is integrated with the pedestal.

Figure 2:
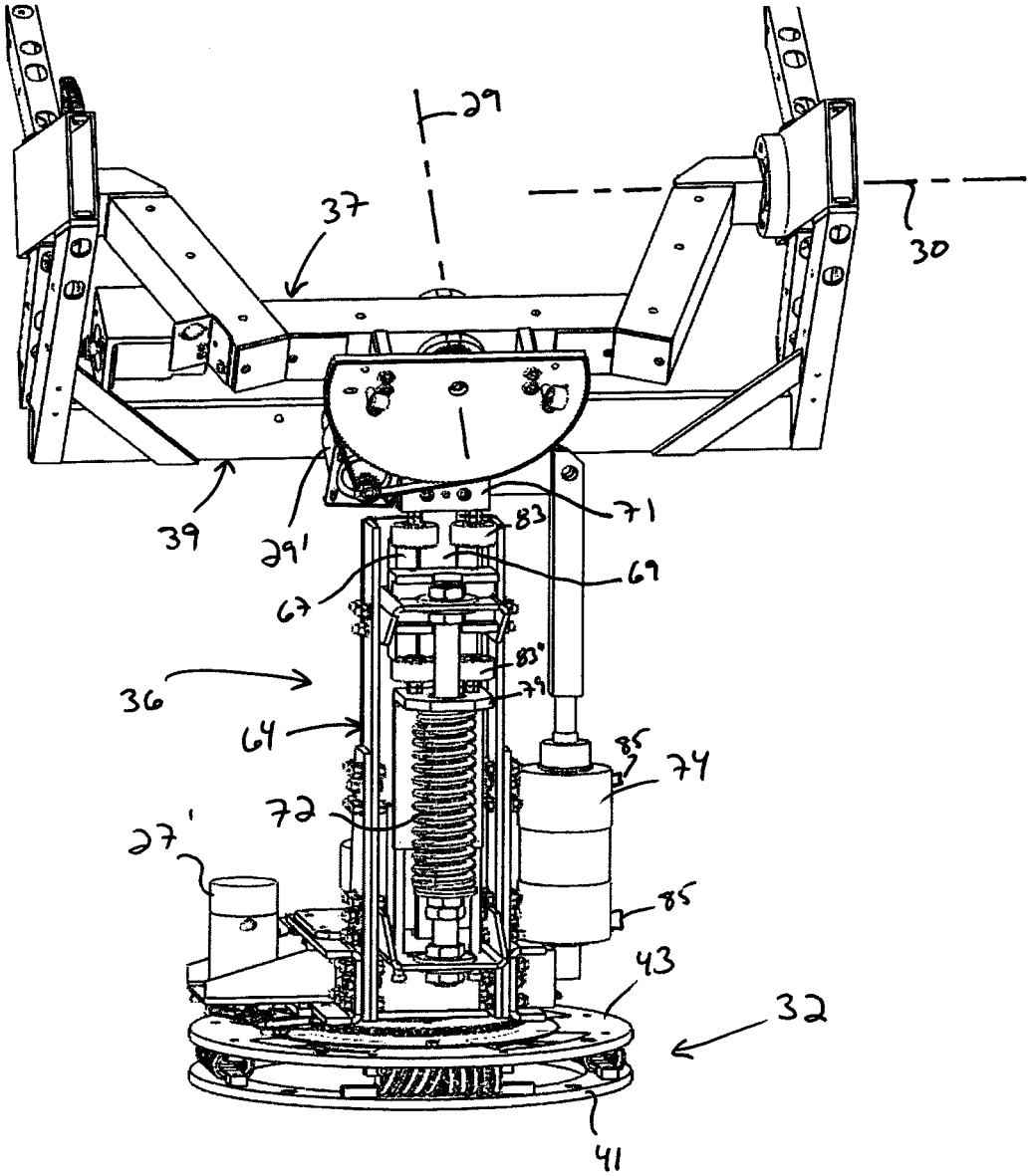
FIG. 2 is a rear perspective view of an exemplary pedestal for tracking antenna in accordance with various aspects of the present invention.
Figure 3:
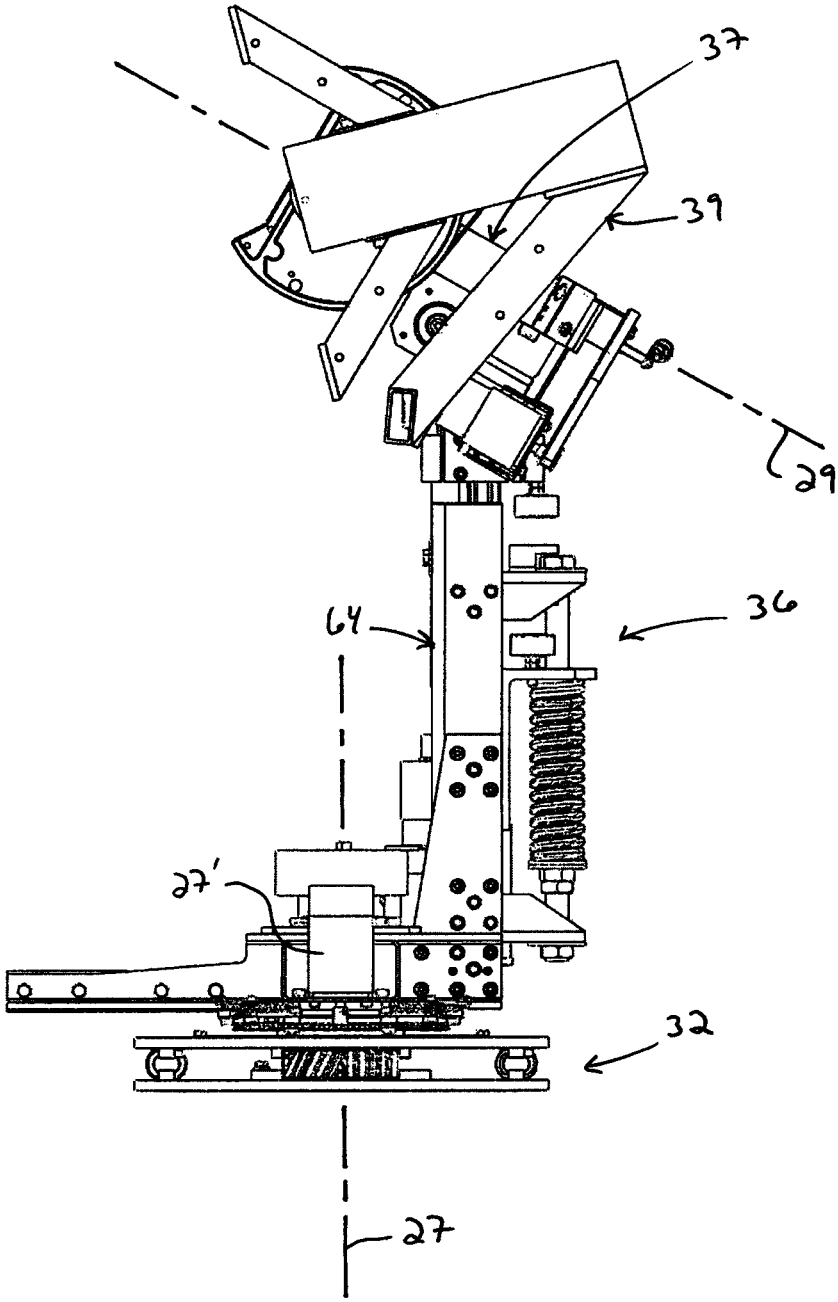
FIG. 3 is a right side view of the pedestal of FIG. 1.

With reference to FIG. 2 and FIG. 3, the servo-control system utilizes otherwise conventional sensors, electronic signal processors, and motor controllers to automatically align the antenna about an azimuth axis 27, a cross-level axis 29, and an elevation axis 30 to appropriate elevation and azimuth angles for accurate tracking of a satellite or other communications device. Preferably, the three axis are mutually intersecting in order to facilitate counterbalancing and minimize drive torque requirements, as discussed in greater detail below.

The pedestal generally includes a horizontal isolation assembly 32, a hub assembly 34 (see FIG. 8 and FIG. 9) rotatably supporting a vertical isolation assembly 36 on the horizontal isolation assembly about the azimuth axis 27. A cross-level frame 37 and an elevation frame 39 are supported by the vertical isolation assembly such that the antenna may pivot about cross-level axis 29 and elevation axis 30 in an otherwise conventional manner.

Figure 6:
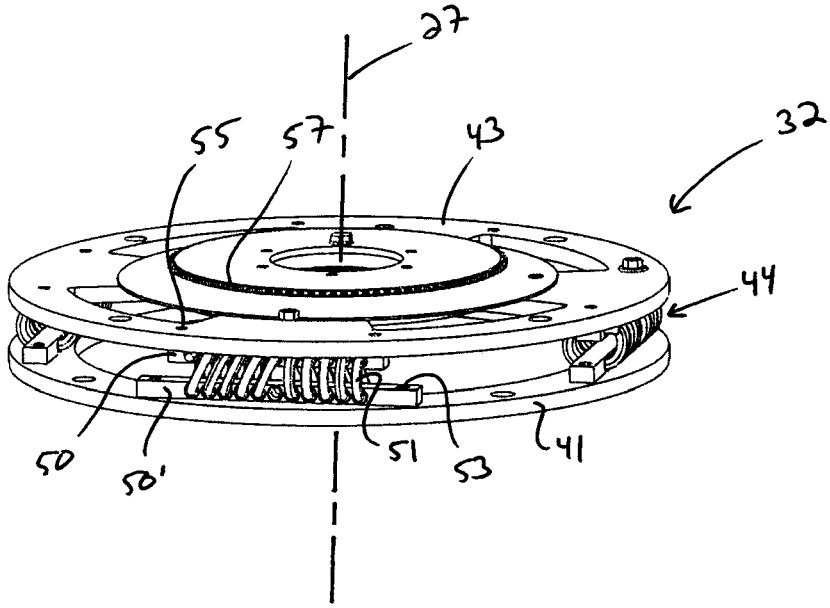
FIG. 6 is an enlarged perspective view of a horizontal isolation assembly of the pedestal of FIG. 1.
Figure 7:
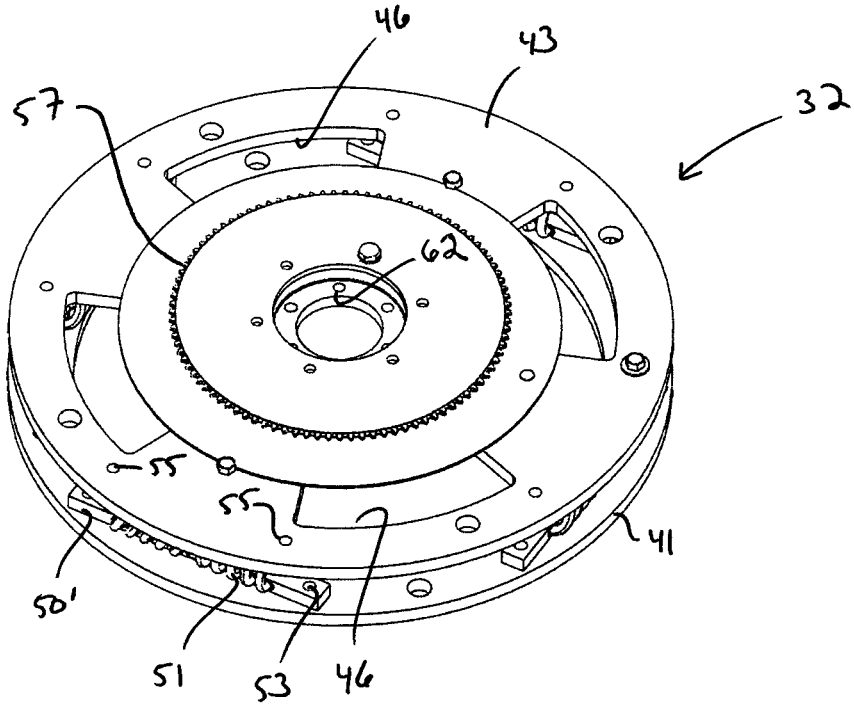
FIG. 7 is an enlarged upper perspective view of a horizontal isolation assembly of the pedestal of FIG. 1.

With reference to FIG. 6 and FIG. 7, the horizontal isolation assembly includes a substantially planar base ring 41 and a support plate 43 which are interconnected by a wire rope isolator 44. The base ring is dimensioned and configured to be affixed to a platform attached to a ship's mast or other suitable mounting surface. For example, the base ring may be fastened along with the radome base 25' (see, e.g., FIG. 1) by nut and bolt or other suitable fastening means to the ship mast platform.

Figure 5:
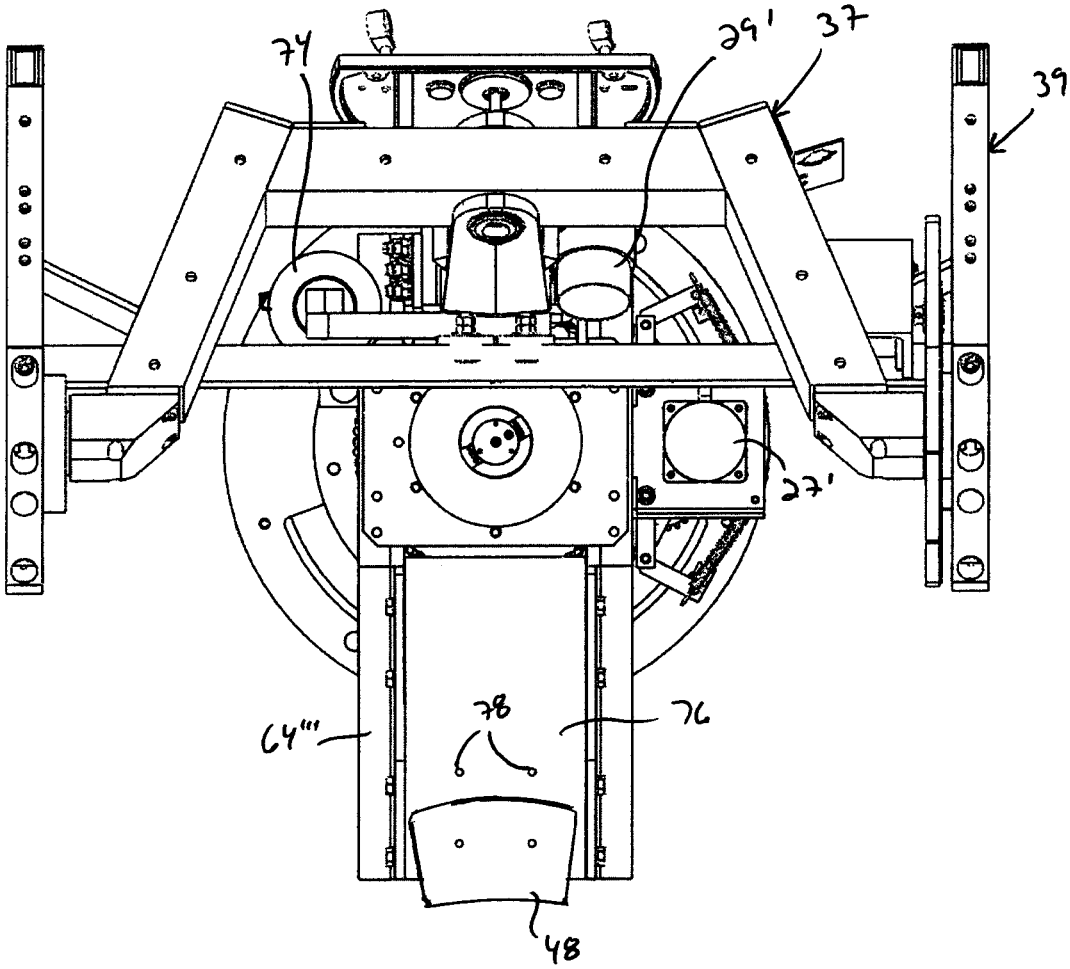
FIG. 5 is a plan view of the pedestal of FIG. 1.

The planar base ring and support plate are preferably formed of plate steel and may be cut to shape by laser cutting, water-jet cutting, oxyacetylene cutting, electron discharge machining (EDM) and other suitable means. As the center of the base ring does not provide significant structural integrity, material may be removed in order to reduce the overall weight of the pedestal. Similarly, material may be removed from the support plate to reduce weight. For example, support plate openings 46 may be removed by laser cutting. In accordance with the present invention, such removed material may be utilized for counterbalancing various components. For example, removed material may be utilized as a counterweight 48 as shown in FIG. 5. As such, waste material may be utilized thereby reducing the need for additional counterweights and contributing to significant costs.

With reference to FIG. 6 and FIG. 7, wire rope isolators 44 are dimensioned and configured to isolate support plate 43 from horizontal vibration and shock subjected to base ring 41 by the ship mast. The wire rope assembly includes upper and lower elongated members 50, 50' respectively mounted on the base ring and support plate, and a wire rope 51 interconnecting the upper and lower elongated members. Each of the elongated members a plurality of transverse through-bores through which the wire rope is threaded. As shown in FIG. 6, the wire rope may skip a through bore. Such configuration may provide additional self-centering as opposing ends of the wire rope slant toward one another.

The illustrated embodiment includes four wire rope assemblies, adjacent ones arranged substantially orthogonal to one another, and other ones being diametrically opposed to one another. One would appreciate that various configurations of two or more wire rope assemblies may be utilized in accordance with the present invention.

In accordance with the present invention, one of the elongated members is longer than the other. For example, lower elongated member 50' is longer than the upper elongated member in order to provide additional clearance for installation and removal of fasteners. For example, the length of the lower elongated member allows the position of fastener hole 53 to be clear of the upper elongated member, and thus provides additional vertical clearance for accessing a bolt or nut used to fasten base ring 41 to a ship mast platform. One will appreciate one has access from above to affix the upper elongated member to support plate 43 by fastener hole 55 in the support plate.

As shown in FIG. 7, a chain-driven sprocket 57 is provided on support plate 43 concentric about azimuth axis 27, as will be discussed in greater detail below.

Figure 8:
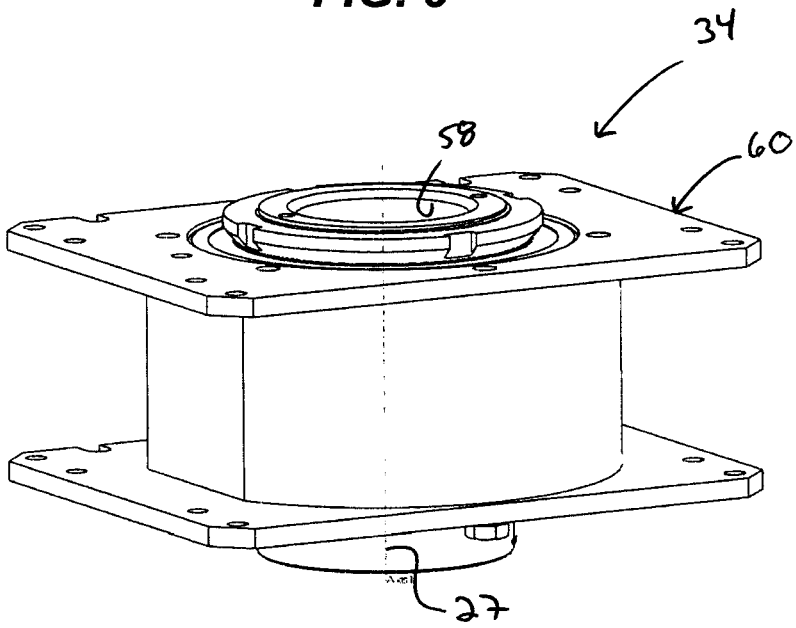
FIG. 8 is an enlarged perspective view of a hub assembly of the pedestal of FIG. 1.
Figure 9:
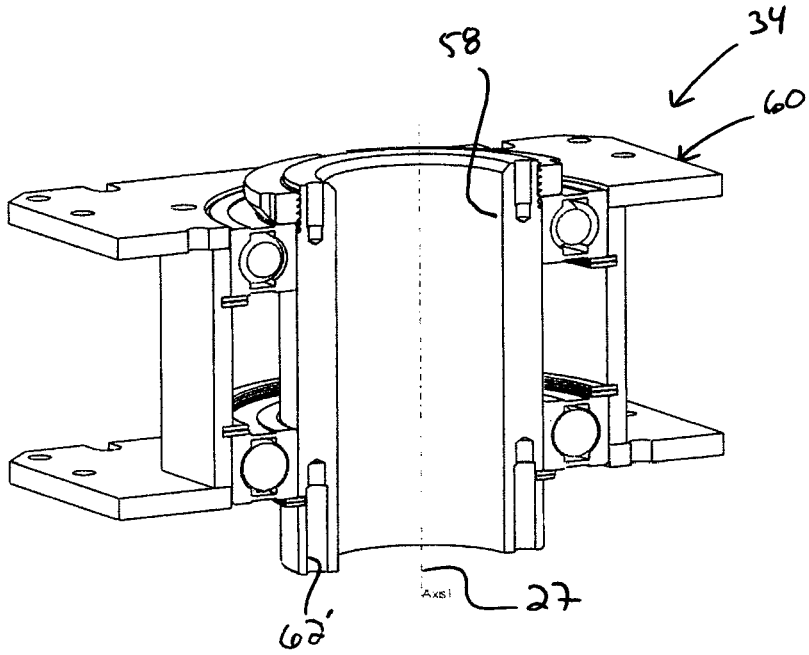
FIG. 9 is a cross-sectional view of the hub assembly of FIG. 8.

With reference to FIG. 8 and FIG. 9, hub assembly 34 includes an azimuth spindle-like support in the form of inner hub collar 58 and a rotating frame in the form of outer hub frame 60 which freely rotates about azimuth axis 27. The inner hub collar is affixed to the support plate by suitable means. For example, an otherwise conventional bolt may be threaded through fastener hole 62 of the support plate (see FIG. 7) and into fastener hole 62' of the inner hub collar (see FIG. 9).

As can be seen in FIG. 9 and in contrast to prior azimuth spindles, the inner hub collar has a relatively large diameter. Preferably, the opening is at least approximately two inches, which configuration provides a significant bearing cross-section thus providing increased structural integrity for supporting the antenna. Also, such configuration provides an significantly larger pass-through for an otherwise conventional rotary joint or other suitable means which may be installed within the inner hub collar to provide cable access to components mounted on the pedestal. For example, a coaxial rotary joint provides for a convenient method for carrying communication signals, antenna stabilization and position command and status information, and electrical power, all of which may be multiplexed on a single coaxial cable. With this arrangement pedestal 20 can accommodate unlimited ship turning maneuvers.

Turning again to FIG. 2 and FIG. 3, vertical isolation assembly 36 supports cross-level frame 37, elevation frame 39, and the antenna. The vertical isolation assembly also provides support for a number of components such as azimuth-axis motor 27' and cross-level-axis motor 29'. In various embodiments, the vertical isolation assembly includes an upright frame 64 that is formed of aluminum plate (e.g., 64') and/or aluminum channel members (e.g., 64"), however, one will appreciate that other suitable means and materials may be used. The plate/channel configuration of the present invention may provide for ease of manufacture thereby contributing to significant reductions in costs.

Vertical isolation assembly 36 includes a profiled linear slide assembly 65 having a pair of bearing blocks 67 affixed to channel member 64" of the upright frame, and a profiled rail 69 that supports cross-level frame 37, and in turn, elevation frame 39 and the antenna (hereinafter, collectively the "Upper Structure"). One will appreciate, however, that one or more bearing blocks may be used in accordance with the present invention. A cross-axis support in the form of a journal member 71 is securely clamped to a top end of the profiled rail to pivotally support the cross-level frame. As such, the vertical isolation assembly allows vertical movement of the Upper Structure relative to channel member 64", and in turn, hub assembly 34, horizontal isolation assembly 32, and the ship-mast platform. The vertical isolation assembly is further provided with a spring 72 and a dampener 74 to effectively isolate the Upper Structure, and most importantly, the antenna from vibration and shock due to environmental stresses such as vibrations caused by shipboard machinery and shocks caused by wave pounding.

In accordance with various aspects of the present invention, the linear slide assembly is dimensioned and configured to allow profiled rail 69 to move with only one degree of freedom with respect to bearing blocks 67, namely, to slide up-and-down with respect to the bearing blocks. Such configuration eliminates the need for additional structure to prevent unwanted vertical twist of the cross-level frame 37 relative to the support plate 43. As such, use of the linear slide assembly provides for a simplified design that significantly reduces part count and significantly facilitates ease of manufacture. Moreover, positioning the linear slide assembly within open channel 64" also facilitates serviceability as it is easily accessible, as can be seen in FIG. 2 and FIG. 10.

Figure 4:
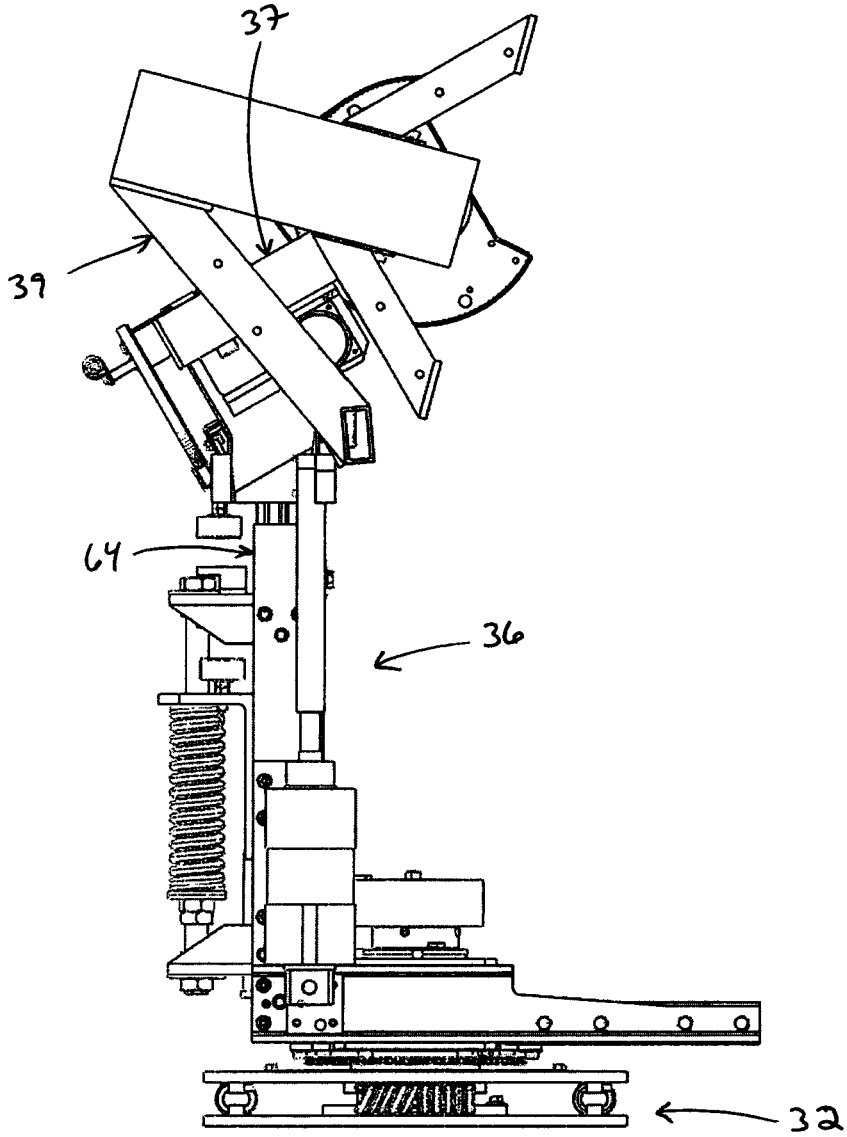
FIG. 4 is a left side view of the pedestal of FIG. 1.

As shown in FIG. 3 and FIG. 4, the linear slide assembly is offset from azimuth axis 27. Such configuration allows a compact design while still allowing cross-level axis 29 and elevation axis 30 intersect substantially along azimuth axis 27.

Figure 10:
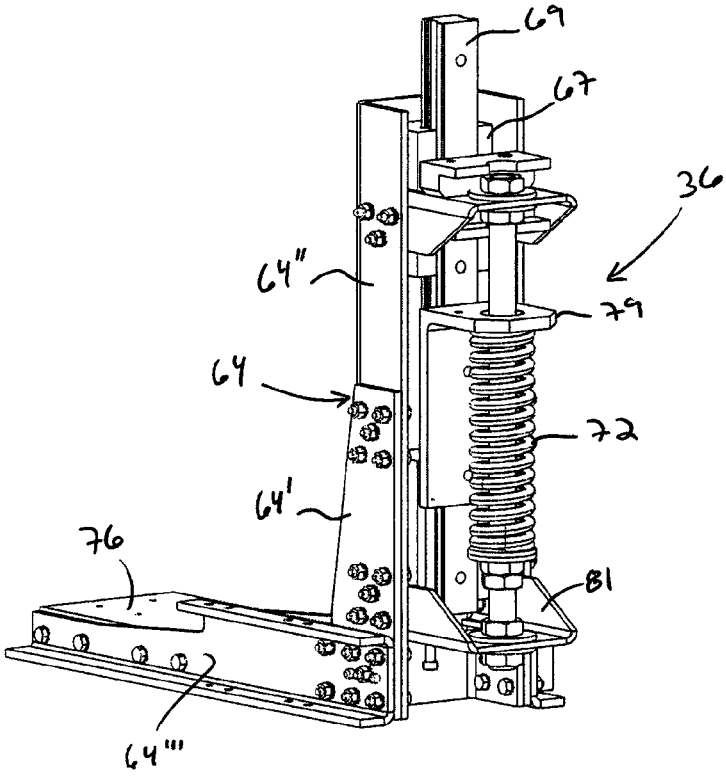
FIG. 10 is an enlarged perspective view of a vertical isolation assembly of the pedestal of FIG. 1.

A counter weight in the form of a block mass 76 is provided on a lower leg 64" of upright frame 64 (see FIG. 10). One will appreciate that the size and weight of the block mass may be easily varied and affixed to the upright frame in order to accommodate for different sized antenna, for example, 40 inch diameter, 60 inch diameter, 80 inch diameter, etc. One will also appreciate that the plate/channel construction of the upright frame allows for ready and simple redesign of the upright frame to accommodate counterweights of varying width.

As shown in FIG. 5, the counterweight may be provided with threaded holes 78 in order to secure additional counterweights thereto. One will appreciate that various patterns of threaded holes may be provided to accommodate various counterweight configurations. For example, counterweight 48 may be threadably affixed via outer holes 78 to for increased balancing, or the counterweight may be threadably affixed via inner holes 78' to decrease the moment of the counterweight by decreasing the moment arm thereof relative the azimuth axis.

Turning now to FIG. 10, vertical isolation assembly 36 is provided with spring 72 to absorb shock and thus isolate the Upper Structure from vibration and shock due to environmental stresses such as vibrations caused by shipboard machinery and shocks caused by pounding waves. In particular, an upper end of the spring is operably connected to profiled rail 69 via an L-shaped spring flange 79 while a lower end of the spring is operably connected to upright frame 64 via a spring bracket 81. As such, the spring supports the weight of the profiled rail and, in turn, the Upper Structure including the antenna, and will settle to a compressed balanced position when no external forces are applied. As external forces due to vibration and shock occur, the spring constant of the spring will absorb energy and thus tends to isolate the Upper Structure from shock and vibration of the ship and, in particular, shock and vibration transmitted to the ship-mast platform.

Figure 11:
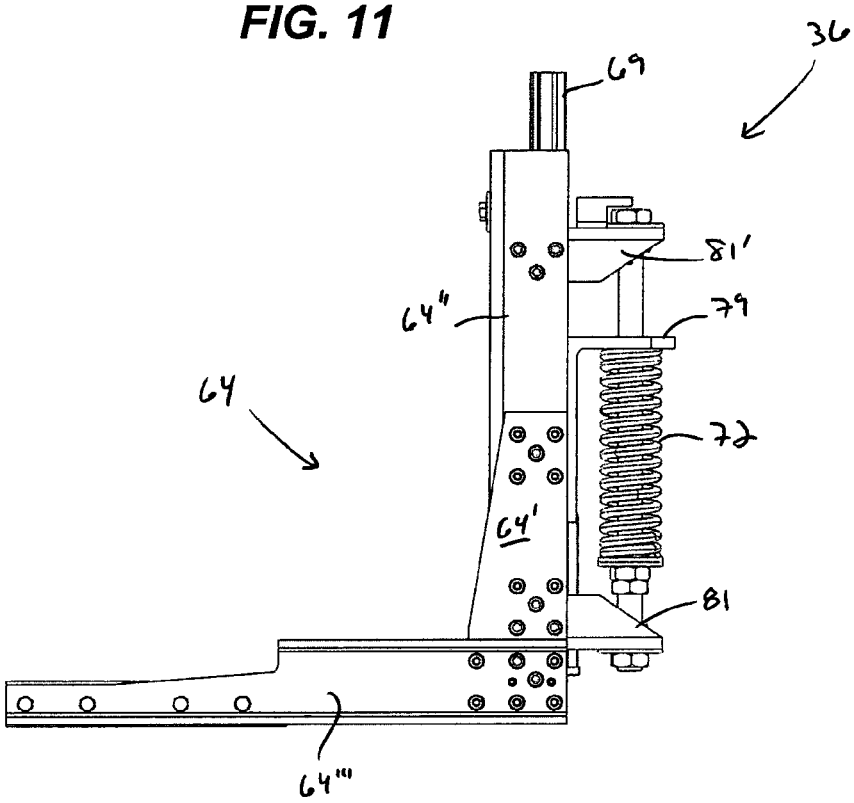
FIG. 11 is a right side view of the vertical isolation assembly FIG. 10.
Figure 12:
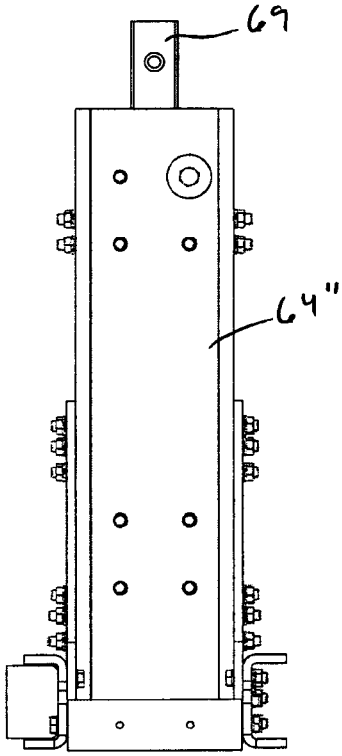
FIG. 12 is a front view of the vertical isolation assembly FIG. 10.
Figure 13:
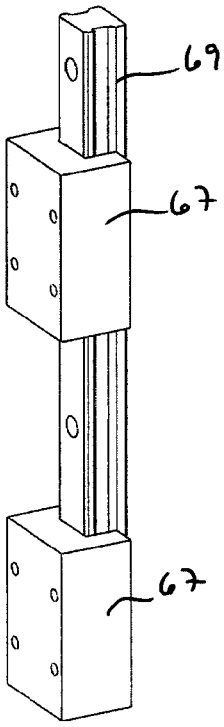
FIG. 13 is an enlarged perspective view of a linear bearing assembly of the vertical isolation assembly of FIG. 10.

As can be seen in FIG. 10 and FIG. 11, the open-channel configuration of upright member 64 allows for ready access to spring 72 and its associated hardware, and thus contributes to ease of manufacture and facilitating maintenance. One will appreciate that the size, shape, material, spring constant, and other variable of the spring may be selected based upon the size and weight of the Upper Structure as well as for other desired parameters. Specifically, the spring may be "tuned" for various applications to match the resonance of the Upper Structure. For example, one would appreciate that the Upper Structure necessary to support an 80 inch dish antenna would generally be heavier than that which supports a 40 inch dish. The relatively simple design of the present invention allows for wide adjustability to accommodate an spring appropriate for antenna of varying size and weight.

Figure 14:
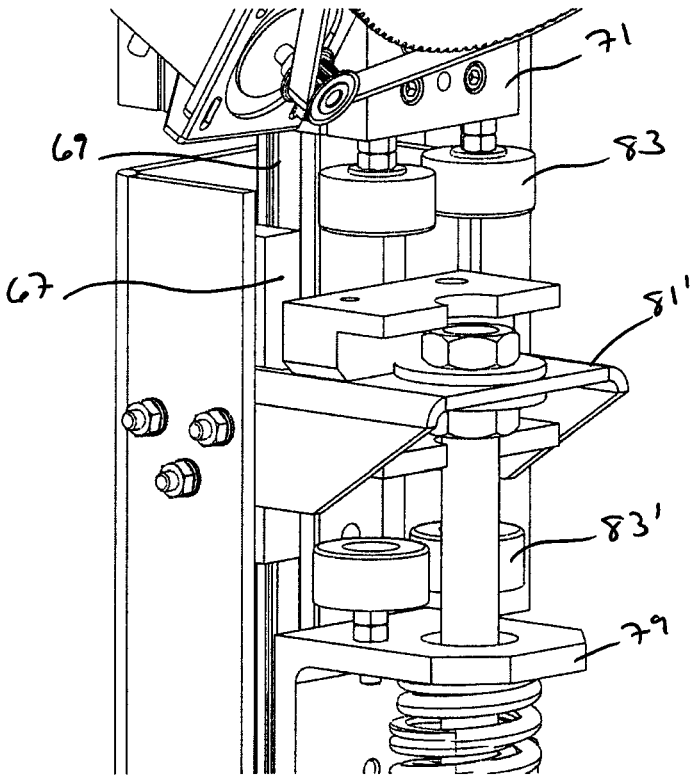
FIG. 14 is an enlarged perspective view of a vertical limit assembly of the vertical isolation assembly of FIG. 10.

With reference to FIG. 2 and FIG. 14, upper and lower stops 83, 83' may be provided to limit downward and upward motion, respectively, of profiled rail 69 and the Upper Structure. For example, lower the lower stops may be provided on spring flange 79 to abut against upper spring bracket 81' to limit upward motion of the profiled rail, while the upper stops may be affixed to journal member 71 to limit downward motion of the profiled rail. The open channel configuration of upright frame 64 allows for great latitude in the distance the slide bearing may travel, however, in various embodiments, the stops are positioned to allow for approximately 20 mm of upward motion and approximately 20 mm of downward motion. One would appreciate the actual amount of travel may vary in accordance with the present invention.

As shown in FIG. 2, dampener 74 is arranged in parallel with spring 72. In particular, a lower end of the dampener is affixed relative to upright frame 64 while an upper end of the dampener is affixed relative to journal member 71 (and profiled rail 69). In accordance with the present invention, the dampener dampens any shock and vibration transmitted by the spring from to the Upper Structure. One would appreciate that when used alone, the lower end of the spring would absorb the energy of shock but may increase the linear amplitude of the shock at the upper end of the shock. For example, testing has shown that a 5 mm vibration input at resonance frequency of the pedestal (a relative standard for testing purposes) into a spring supported system may give rise to a 50-70 mm output response of the pedestal, a 10× to 12× increase in amplitude. Due to inertia, spring coefficients and other factors, the spring may actually increase the linear amplitude of shock while absorbing energy of the shock.

In accordance with various aspects of the present invention, the dampener may be utilized to significantly decrease such effects. Testing has shown that linear amplitude of a 5 mm vibration input at resonance frequency of the pedestal may be reduced to a 12-13 mm output response of the pedestal, that is, a reduction to less than approximately 3×. As such output linear amplitude is reduced, the likelihood of bottoming-out or topping-out may be reduced thus promoting the lifespan of the pedestal. As noted above, stops 83, 83' are provided to allow for approximately 20 mm of travel, and thus topping and bottoming out may be avoided or at least significantly reduced.

In various embodiments, the dampener is a pneumatic dampener, preferably in the form of a double-acting cylinder open to atmosphere, however, one would appreciate that other suitable dampeners may be utilized in accordance with the present invention. Nonetheless, a double-acting pneumatic dampener may provide significant advantages over other dampeners, for instance hydraulic dampeners, as pneumatic dampeners may be lighter and not prone to leakage. For example, a Clippard Minimatic® stainless steel cylinders (provided by Clippard Instrument Laboratory, Inc. of Cincinnati, Ohio) or other suitable cylinder may be utilized. In various embodiments, a three inch bore cylinder having a piston with Viton® seals may be utilized to provide.

Preferably, the cylinder is open to atmosphere, thus providing a simplified design. Such configuration also promotes cooling as ambient air will be drawn into the cylinder whenever the cylinder rod moves up or down in unison with the Upper Structure (e.g., the antenna). In the instances that the cylinder is open to atmosphere, the dampening of the cylinder may be tuned by using differently sized port fittings or jets 85. For example, by utilizing a jet with a narrower inner diameter, airflow may be restricted to increase dampening. Alternatively, the port fitting may include or connect to an adjustable valve in order to "tune" the dampener to the desired dampening effect.

Figure 15:
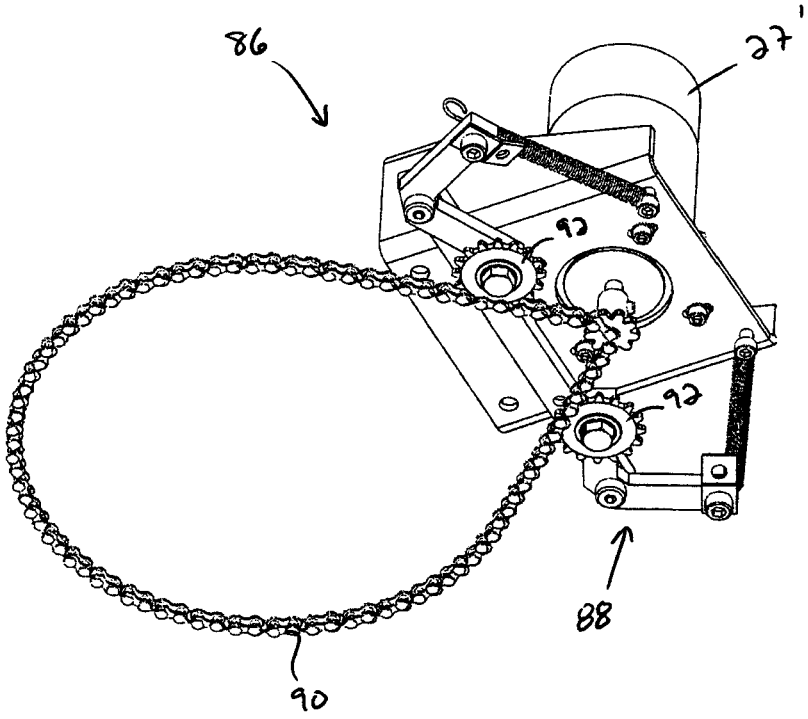
FIG. 15 is a lower perspective view of an azimuth axis chain drive assembly of the pedestal of FIG. 1.

Turning now to FIG. 15, a chain-drive assembly 86 with tensioner 88 may be provided to allow for rotational movement of vertical isolation assembly 36 and the Upper Structure about the azimuth axis 27 (see, e.g., FIG. 3). As noted above, chain driven sprocket 57 is provided on support plate 43 concentric about azimuth axis 27, and is driven by azimuth-axis motor 27', which is mounted on upright frame 64 via a motor bracket 27", as shown in FIG. 2. Such configuration allows the driven azimuth gear (i.e., sprocket 57) be mounted below upright frame 64. Thus, the azimuth-axis motor may be mounted low and to one side of the upright frame in such a manner that it does not obstruct movement of the antenna. Also, such arrangement does not require significant redesign for various sized antenna. For example, various sprocket sizes may be utilized and various motor sizes may be utilized without any redesign of motor bracket 27" and/or supporting hardware.

In various embodiments, a drive chain 90 is utilized to transmit driving power from azimuth-axis motor 27' to sprocket 57 for rotating pedestal about the azimuth axis. Use of a chain is particularly conducive to assembly and maintenance as the chain may be installed and removed by means of an otherwise conventional master link, thus obviating the need to disassemble any other components. In some aspects, use of a chain makes it possible to position the drive sprocket below the upright frame 64 and between the vertical isolation assembly 36 and the horizontal isolation assembly.

With continued reference to FIG. 15, tensioner 88 is provided with spring biased pulleys 92 to symmetrically tension the chain about the drive sprocket of motor 27" and sprocket 57. Such configuration may increase tracking accuracy and allows the tensioner to be "tuned" for various sized antenna. For example, larger springs may be utilized for a heavier Upper Structure, while smaller springs may be utilized for a lighter Upper Structure. In any event, the configuration of the tensioner allows for ready serviceability of both the chain and the tensioner springs.

Preferably, the structural members of the pedestal are designed to be exceedingly stiff and strong so as to survive severe shipboard environments. Toward this end these members may be fabricated of metal extrusions and/or plates. As noted above, the upright frame may be formed of aluminum channel and plate, and the base ring and support plate are formed of plate steel. One will appreciate, however, that various metals and alloys thereof, glass fiber and/or other composite materials, other suitable materials, and combinations thereof may be used for these structural members.

To minimize drive torque requirements, each of the pivoting members in the pedestal may be counterbalanced to obtain static balance about its pivot axis. Thus, the antenna with its intermediate support members is statically balanced about the elevation axis, the level platform assembly is statically balanced about its axis, the level beam assembly is statically balanced about the cross-level axis, and the Upper Structure and the vertical isolation assembly is statically balanced about the azimuth axis. This static balancing removes from the pedestal virtually all disturbing torques caused by heave, surge, sway, and by tangential accelerations resulting from roll and pitch ship motions. Also, the axis arrangement results in elimination of most inertia loads from the pedestal drive means. As a result, relatively small and light drive means may be used in the present invention.

Advantageously, a pedestal in accordance with various aspects of the present invention provides for an improved stabilized antenna pedestal which occupies a minimum of space while accommodating very large amplitude ship motions.

Also, a pedestal in accordance with various aspects of the present invention to provide an improved maritime satellite tracking antenna pedestal apparatus which provides accurate pointing, is reliable in operation, is easily maintained, uncomplicated, and economical to fabricate.

Further, a pedestal in accordance with various aspects of the present invention to provide an improved stabilized antenna pedestal which is substantially rigid and strong so as to be capable of withstanding moments, pressures, vibration, shock, and other forces when disposed in operational relationship with a ship at sea, as on the mast of the ship, and yet is light in weight.

Figure 16:
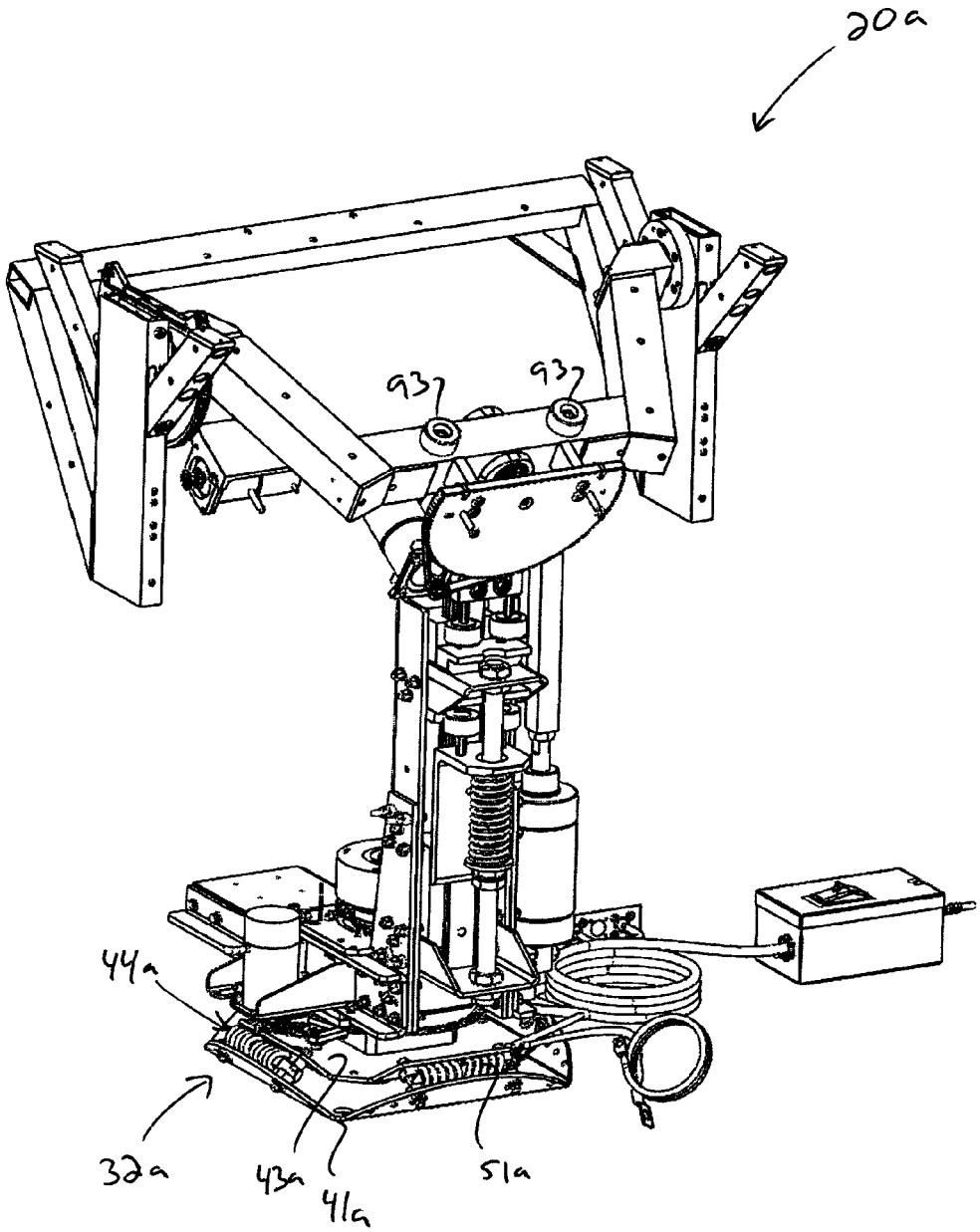
FIG. 16 is a rear perspective view of another exemplary pedestal for tracking antenna in accordance with various aspects of the present invention.

In another exemplary embodiment of the present invention, a three-axis pedestal **20*a* is similar to three-axis pedestal 20 described above but includes a modified horizontal isolation assembly 32*a* and antenna bumpers 93 which serve as a mechanical stop for the antenna dish at high look angles, as shown in FIG. 16. Like reference numerals have been used to describe like components of three-axis pedestal 20*a*** and the above-described three-axis pedestal.

In this embodiment, horizontal isolation assembly 20*a* includes an angled base plate 41*a* and an angled support plate 43*a* which are interconnected by a wire rope isolator 51*a*. The base plate is dimensioned and configured to be affixed to a platform attached to a ship's mast or other suitable mounting surface. For example, the base ring may be fastened along with the radome base 25' (see, e.g., FIG. 1) by nut and bolt or other suitable fastening means to the ship mast platform.

The configuration of the angled base and support plates 41*a* and 43*a* provides for a long life of the wire-ropes at resonance frequency (horizontal resonance frequency) which in turn provides for long cycle time before maintenance or replacement.

Similar to the base ring and support plate discussed above, the base plate and support plate are preferably formed of plate steel and may be cut to shape by laser cutting, water-jet cutting, oxyacetylene cutting, electron discharge machining (EDM) and other suitable means. Material may be removed from the support plate to reduce weight, which material may be utilized for counterbalancing various components, as discussed above.

Figure 17:
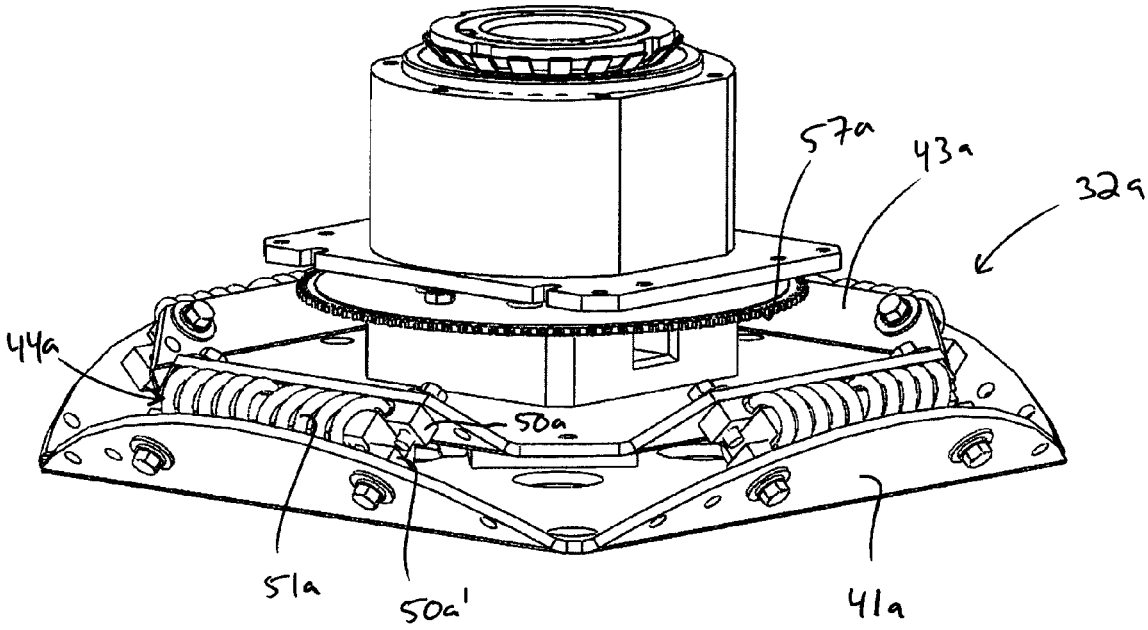
FIG. 17 is an enlarged perspective view of a horizontal isolation assembly of the pedestal of FIG. 16.
Figure 18:
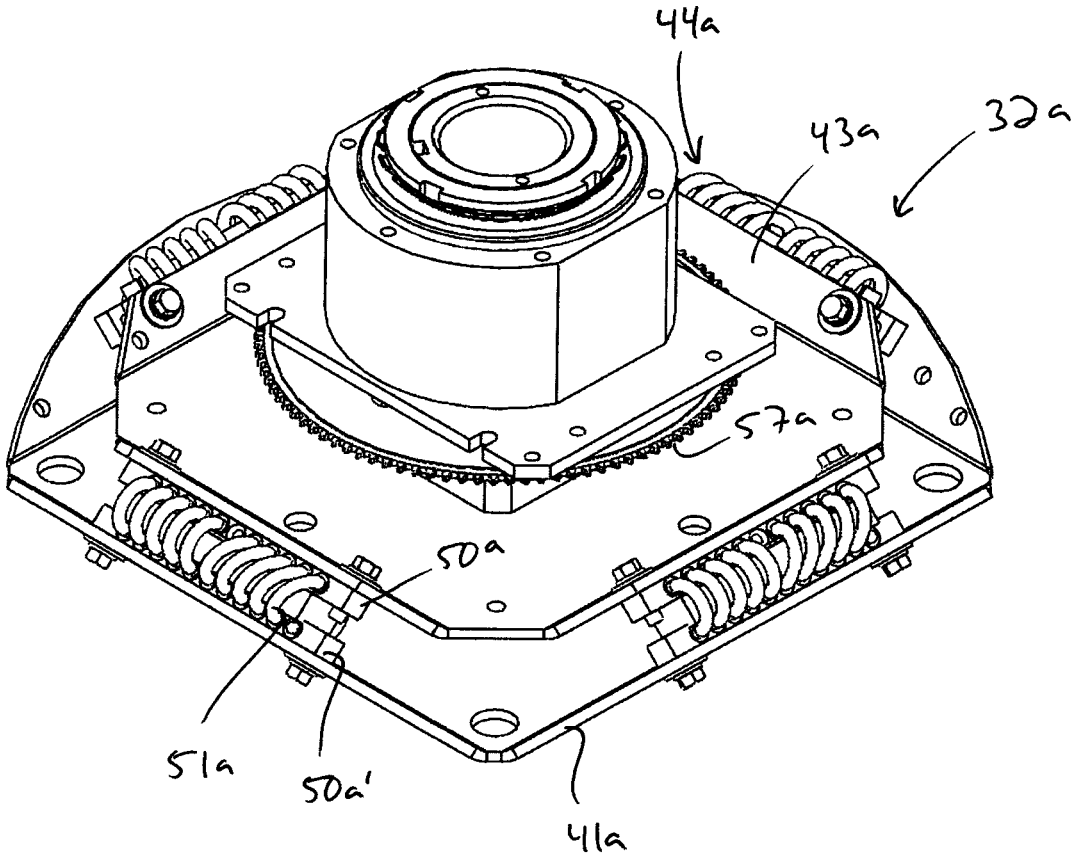
FIG. 18 is an enlarged upper perspective view of a horizontal isolation assembly of the pedestal of FIG. 16.

With reference to FIG. 17 and FIG. 18, wire rope isolators 44*a* are dimensioned and configured to isolate support plate 43*a* from horizontal vibration and shock subjected to base plate 41*a* by the ship mast. The wire rope assembly includes upper and lower elongated members 50*a*, 50*a*' respectively mounted on the base ring and support plate, and a wire rope 51*a* interconnecting the upper and lower elongated members. Each of the elongated members a plurality of transverse through-bores through which the wire rope is threaded. As best seen in FIG. 18, the wire rope may skip a through bore. Such configuration may provide additional self-centering as opposing ends of the wire rope slant toward one another.

The illustrated embodiment includes four wire rope assemblies, adjacent ones arranged substantially orthogonal to one another, and other ones being diametrically opposed to one another. One would appreciate that various configurations of two or more wire rope assemblies may be utilized in accordance with the present invention.

As shown in FIG. 17 and FIG. 18, a chain-driven sprocket 57*a* is provided on support plate 43*a* concentric about azimuth axis 27*a* in a manner similar to that discussed above. In operation and use, three-axis pedestal 20*a* is used in substantially the same manner as three-axis pedestal 20 discussed above.

For convenience in explanation and accurate definition in the appended claims, the terms "upper", "lower", "front", and etc. are used to describe features of the exemplary embodiments with reference to the positions of such features as displayed in the figures.

In many respects various modified features of the various figures resemble those of preceding features and the same reference numerals followed by subscripts "a" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pedestal for a tracking antenna for obtaining rotational stabilization of the antenna about three axes, said pedestal comprising:

a horizontal isolation assembly dimensioned and configured to isolate a support plate from horizontal vibration and shock of a base ring;

a hub assembly including a support mounted on the horizontal isolation assembly rotatably supporting a rotating frame about a first azimuth axis;

a vertical isolation assembly including an upright frame and a cross-level axis support slidably interconnected with a linear bearing assembly, the linear bearing assembly having a profiled rail slidably received within a complementary shaped bearing block, wherein the profiled rail can not twist axially relative to the bearing block;

a cross-level frame pivotally mounted on the cross-level axis support about a second cross-level axis; and an elevation frame assembly supporting the tracking antenna and pivotally mounted on the cross-level frame about a third elevation axis.

2. The pedestal of claim 1, wherein the horizontal isolation assembly includes a base and a support plate interconnected by a wire rope assembly dimensioned and configured to isolate the support plate from horizontal vibration and shock of the base;

wherein the wire rope assembly includes upper and lower elongated members respectively mounted on the base and support plate, and a wire rope interconnecting the upper and lower elongated members; and wherein one of the upper and lower elongated members is longer than the other of the upper and lower elongated members whereby a fastening aperture of said one elongated member is spaced from and does not face said other elongated member.

3. The pedestal of claim 2, wherein the upper and lower elongated members each include a plurality of transverse through-bores, and wherein the wire rope is threaded through all but a central one of the through-bores.

4. The pedestal of claim 1, wherein wherein the support of the hub assembly includes a collar fixedly mounted on the support plate of the horizontal isolation assembly.

5. The pedestal of claim 1, wherein the linear bearing assembly is offset from and substantially parallel to the first axis, and the second and third axis intersect one another substantially along the first axis.

6. The pedestal of claim 1, wherein the base of the vertical isolation assembly includes a counterweight diametrically opposed from the linear bearing assembly with respect to the first azimuth axis.

7. The pedestal of claim 6, wherein the counterweight includes material that has been removed from a support plate of the horizontal isolation assembly.

8. The pedestal of claim 1, wherein the vertical isolation assembly further includes a support spring and a dampener interconnecting the upright frame and cross-level axis support.

9. The pedestal of claim 8, wherein the support spring and dampener are arranged in parallel with one another.

10. The pedestal of claim 8, wherein the dampener is a pneumatic cylinder open to atmosphere.

11. The pedestal of claim 1, wherein the horizontal isolation assembly further includes a driven gear affixed to the support plate; and the vertical isolation assembly further includes an azimuth-axis drive motor operably connected to the driven gear.

12. The pedestal of claim 11, wherein the driven gear is a sprocket, and wherein a drive chain located between the vertical isolation assembly and the horizontal isolation assembly operably connects the azimuth-axis drive motor to the sprocket.

13. A pedestal for a tracking antenna for obtaining rotational stabilization of the antenna about three axes, said pedestal comprising:

a horizontal isolation assembly dimensioned and configured to isolate a support plate from horizontal vibration and shock of a base;

a hub assembly including a support mounted on the horizontal isolation assembly rotatably supporting a rotating frame about a first azimuth axis;

a vertical isolation assembly including an upright frame and a cross-level axis support slidably interconnected with a linear bearing assembly, the vertical isolation assembly further including a support spring and a dampener interconnecting the upright frame and cross-level axis support to dampen relative movement between the cross-level axis support and the upright frame;

a cross-level frame pivotally mounted on the cross-level axis support about a second cross-level axis; and an elevation frame assembly supporting the tracking antenna and pivotally mounted on the cross-level frame about a third elevation axis.

14. The pedestal of claim 13, wherein the horizontal isolation assembly includes a base and a support plate interconnected by a wire rope assembly dimensioned and configured to isolate the support plate from horizontal vibration and shock of the base;

wherein the wire rope assembly includes upper and lower elongated members respectively mounted on the base and support plate, and a wire rope interconnecting the upper and lower elongated members; and wherein one of the upper and lower elongated members is longer than the other of the upper and lower elongated members whereby a fastening aperture of said one elongated member is spaced from and does not face said other elongated member.

15. The pedestal of claim 14, wherein the upper and lower elongated members each include a plurality of transverse through-bores, and wherein the wire rope is threaded through all but a central one of the through-bores.

16. The pedestal of claim 13, wherein wherein the support of the hub assembly includes a collar fixedly mounted on the support plate of the horizontal isolation assembly.

17. The pedestal of claim 13, wherein the linear bearing assembly is offset from and substantially parallel to the first axis, and the second and third axis intersect one another substantially along the first axis.

18. The pedestal of claim 13, wherein the base of the vertical isolation assembly includes a counterweight diametrically opposed from the linear bearing assembly with respect to the first azimuth axis.

19. The pedestal of claim 18, wherein the counterweight includes material that has been removed from a support plate of the horizontal isolation assembly.

20. The pedestal of claim 18, wherein the dampener is a pneumatic cylinder open to atmosphere.

21. The pedestal of claim 13, wherein the linear bearing assembly having a profiled rail supporting the cross-level axis support and being slidably received within a complementary shaped bearing block affixed to the upright frame, wherein the profiled rail can not twist axially relative to the bearing block.

22. A pedestal for a tracking antenna for obtaining rotational stabilization of the antenna about three axes, said pedestal comprising:

a horizontal isolation assembly dimensioned and configured to isolate a support plate from horizontal vibration and shock of a base, the horizontal isolation assembly including a driven gear affixed to the support plate;

a hub assembly including a support mounted on the horizontal isolation assembly rotatably supporting a rotating frame about a first azimuth axis;

a vertical isolation assembly including an upright frame and a cross-level axis support slidably interconnected with a linear bearing assembly, the vertical isolation assembly further including an azimuth-axis drive motor operably connected to the driven gear;

a cross-level frame pivotally mounted on the cross-level axis support about a second cross-level axis; and an elevation frame assembly supporting the tracking antenna and pivotally mounted on the cross-level frame about a third elevation axis.

23. The pedestal of claim 22, wherein the driven gear is a sprocket located between the vertical isolation assembly and the horizontal isolation assembly, and wherein and a drive chain operably connects the azimuth-axis drive motor to the sprocket.

* * * * *